US008210774B1

(12) United States Patent
Vidovic et al.

(10) Patent No.: US 8,210,774 B1
(45) Date of Patent: Jul. 3, 2012

(54) GUIDED BORING MACHINE AND METHOD

(75) Inventors: David A. Vidovic, West Salem, OH (US); Michael W. Thomas, Warsaw, OH (US)

(73) Assignee: Astec Industries, Inc., Chattanooga, TN (US)

( * ) Notice: Subject to any disclaimer, the term of this patent is extended or adjusted under 35 U.S.C. 154(b) by 235 days.

(21) Appl. No.: 12/800,669

(22) Filed: May 20, 2010

(51) Int. Cl.
*E21D 9/087* (2006.01)
*E02D 29/00* (2006.01)

(52) U.S. Cl. ..... 405/143; 405/138; 405/141; 405/184; 299/56; 175/62

(58) Field of Classification Search ..... 405/138, 405/143, 141, 184; 299/55, 56, 68, 18; 175/61, 175/62
See application file for complete search history.

(56) References Cited

U.S. PATENT DOCUMENTS

| | | | |
|---|---|---|---|
| 1,371,224 | A | 3/1921 | Campbell |
| 1,403,530 | A | 1/1922 | Whitaker et al. |
| 1,462,997 | A | 7/1923 | Anderson |
| 1,478,466 | A | 12/1923 | Anderson |
| 1,511,957 | A | 10/1924 | Freda |
| RE24,965 | E | 4/1961 | Kirkpatrick |
| 2,988,348 | A | 6/1961 | Robbins |
| 3,061,288 | A | 10/1962 | Robbins |
| 3,139,148 | A | 6/1964 | Robbins |
| 3,237,990 | A | 3/1966 | Robbins |

(Continued)

FOREIGN PATENT DOCUMENTS

| | | |
|---|---|---|
| JP | 08170489 A | 7/1996 |
| WO | WO96/06264 | 2/1996 |

OTHER PUBLICATIONS

Pipe Jacking, Microtunnelling, Tunnelling & Auger Boring; Trenchless Works; 2009 NoDig Media Services.

(Continued)

*Primary Examiner* — Sunil Singh
*Assistant Examiner* — Kyle Armstrong
(74) *Attorney, Agent, or Firm* — Chambliss, Bahner & Stophel, P.C.

(57) ABSTRACT

A guided boring machine includes a cutter head, a steering head and an internal casing with an auger therein for conveying material cut by the cutter head towards the rear end of the auger. The boring machine bores a tunnel from a launch pit to a target pit along a desired boring direction and simultaneously installing a selected one of a plurality of differently-sized product casings in the tunnel. When the internal casing is placed within a selected product casing with its internal casing longitudinal axis coincident with the longitudinal axis of the selected product casing, an annular space is formed with respect to the selected product casing. The guidance assembly includes a laser that is mounted behind the boring machine and oriented so as to direct its beam in a desired boring direction within the annular space. A target mount is mounted to the steering head inside surface. The target mount includes a roll correction slot which is parallel to the adjacent steering head inside surface. A target is mounted to the target mount and adapted to move with respect thereto. The target has a target point which is intersected by the laser beam when the cutter head is properly oriented with respect to the desired boring direction. A gradiometer is mounted to the target to indicate the roll orientation of the steering head, and a roll correction assembly is provided to roll the steering head, if desired, to adjust its roll orientation.

17 Claims, 12 Drawing Sheets

U.S. PATENT DOCUMENTS

| | | | | | |
|---|---|---|---|---|---|
| 3,290,098 | A | | 12/1966 | Scott | |
| 3,321,148 | A | | 5/1967 | Williamson | |
| 3,321,248 | A | * | 5/1967 | Williamson et al. | 299/1.3 |
| 3,421,796 | A | | 1/1969 | Barrett | |
| 3,467,437 | A | | 9/1969 | Bolotin | |
| 3,517,966 | A | | 6/1970 | Montacie | |
| 3,672,726 | A | | 6/1972 | House | |
| 3,812,679 | A | | 5/1974 | Ruemmele | |
| 3,865,196 | A | | 2/1975 | Winberg | |
| 4,013,134 | A | | 3/1977 | Richmond | |
| 4,142,763 | A | | 3/1979 | Kumaki | |
| 4,312,541 | A | | 1/1982 | Spurgeon | |
| 4,394,881 | A | | 7/1983 | Shirley | |
| 4,416,339 | A | | 11/1983 | Baker | |
| 4,527,837 | A | | 7/1985 | Snyder | |
| 4,589,502 | A | | 5/1986 | Salter | |
| 4,637,657 | A | | 1/1987 | Snyder | |
| 4,646,853 | A | | 3/1987 | Sugden | |
| 4,874,267 | A | | 10/1989 | Ince | |
| 4,936,709 | A | * | 6/1990 | Kimura | 405/184 |
| 5,046,783 | A | | 9/1991 | Emanuelsson | |
| 5,061,120 | A | | 10/1991 | Akesaka | |
| 5,099,927 | A | | 3/1992 | Gibson | |
| 5,125,768 | A | | 6/1992 | Ilomaki | |
| 5,284,403 | A | | 2/1994 | Ilomaki | |
| 5,295,734 | A | | 3/1994 | Klomaki | |
| 5,361,854 | A | * | 11/1994 | Tull et al. | 175/45 |
| 5,437,500 | A | | 8/1995 | Lehmann | |
| 5,470,132 | A | * | 11/1995 | Cartwright | 299/56 |
| 5,529,437 | A | * | 6/1996 | Filipowski et al. | 405/143 |
| 5,813,482 | A | * | 9/1998 | Barbera | 175/61 |
| 5,863,101 | A | | 1/1999 | Seear | |
| 5,890,771 | A | | 4/1999 | Cass | |
| 6,142,577 | A | | 11/2000 | Tayama | |
| 6,206,109 | B1 | | 3/2001 | Monier | |
| 6,431,653 | B1 | | 8/2002 | Kleuters | |
| 6,688,408 | B2 | | 2/2004 | Barbera | |
| 7,048,050 | B2 | | 5/2006 | Vail, III | |
| 7,195,079 | B2 | | 3/2007 | Self | |
| 7,195,083 | B2 | | 3/2007 | Eppink | |
| 7,510,025 | B2 | * | 3/2009 | Davies | 175/26 |
| 2009/0078461 | A1 | * | 3/2009 | Mansure et al. | 175/17 |
| 2009/0152012 | A1 | | 6/2009 | Salins | |
| 2009/0297273 | A1 | * | 12/2009 | Lindbergh et al. | 405/138 |

OTHER PUBLICATIONS

Akkerman Marketing Brochure for Powered Reaming Head.

* cited by examiner

GUIDED BORING MACHINE AND METHOD

FIELD OF THE INVENTION

The invention relates generally to a guided tunnel boring machine. More particularly, the invention relates to such a boring machine which is adapted to install a plurality of differently-sized product casings in a bore. The invention relates to a guidance system for such a boring machine that may be employed so that an operator may make steering adjustments, as well as roll adjustments, to the boring machine during the tunnel boring operation.

BACKGROUND OF THE INVENTION

Subterranean boring machines are used to install a pipe comprised of multiple casing sections or a similar product in the ground without excavating a trench for the pipe. Some boring machines are used to bore a generally horizontal hole and to install a plurality of pipe sections therein between a generally vertical launch shaft or pit and a similarly oriented target shaft or pit. The launch shaft or pit is excavated to a depth to permit the boring machine to be placed in alignment and on grade with the desired underground installation. Boring machines that are commonly placed in such launch pits generally include a track that is located at the bottom of the launch pit and oriented along the desired boring direction, and a carriage that rolls or otherwise travels along the track. The carriage includes a pusher mechanism that is adapted to move the carriage along the track between a start point and a terminal point, and a rotational mechanism that is adapted to rotate a tool carried by the boring machine.

In some conventional boring machines, a pilot hole is first bored along the centerline of the intended product bore. Some such machines use a small pilot head having an inclined face at its leading end. Typically, the pilot system will include a hollow casing, and the pilot head will include an illuminated target on its trailing end. A theodolite mounted at a fixed position in the launch pit apart from the boring machine is aligned so that an operator can view the position of the illuminated target on the pilot head with respect to the cross-hairs of the theodolite. The first section of the pilot casing and the pilot head are pushed into the ground in the boring direction by the pusher mechanism without rotating the pilot head. However, because the inclined face on the pilot head gives rise to a reaction force exerted by the soil through which the head moves, rotation of the head as it is pushed in the boring direction may be required to keep the head on the desired course, as indicated by the position of the target with respect to the cross-hairs of the theodolite. When the carriage reaches the terminal point of the track, the pilot head is disengaged and the carriage is withdrawn to the start point. Multiple sections of pilot casing are added, one by one, to the end of the pilot string and pushed by the pusher mechanism until the pilot head reaches the target pit. After the pilot hole is completed, a boring assembly having an outer diameter that corresponds to the outer diameter of the product casing to be installed is selected. This boring assembly, which comprises a support casing with a cutter head at the leading end and an internal material removal auger or other conveyor located behind the cutter head, is lowered into the launch pit and mounted on the carriage. The boring assembly is attached to the rear end of the pilot casing and aligned with the pilot hole. As the carriage is then pushed or driven along the track following the pilot line, the cutter head is operated to bore a hole centered on the pilot bore, and the conveyor is operated to carry the cuttings back towards the launch pit. A plurality of spoil paddles located in a front section of the carriage sweep the cuttings out of the boring machine and into the launch pit through openings provided for that purpose. When the carriage reaches the terminal point of the track, the support casing and internal conveyor are disengaged and the carriage is retracted to the start point. The pilot head is removed from the pilot casing string in the target pit, and an additional section of support casing with an internal conveyor section is mounted to the carriage and attached to the casing and conveyor sections that were disengaged from the carriage. Then the carriage is engaged to drive the support casing further in the boring direction while operating the cutter head and the internal conveyor. Multiple sections of this cutting assembly are added, and the pilot system is removed, piece by piece, from the target pit, until the cutter head reaches the target pit. Then the support casing and conveyor sections are removed, one by one, as product pipe sections of the same outer diameter as the boring assembly are pushed by the carriage into the bore.

A variation on this type of guidance system is offered by the Bohrtec subsidiary of Herrenknecht in a machine which may be used for small-diameter tunnels and does not require the formation of a pilot bore. The Bohrtec machine employs a boring assembly, carriage and track such as is employed by conventional machines that use a pilot bore, as well as an optical guidance system that employs a theodolite mounted at a fixed position in the launch pit apart from the boring machine. The theodolite is aligned so that an operator can view the position of an illuminated target on the back of the cutter head through the hollow shaft of an auger conveyor. The cutter head on the Bohrtec machine is mounted to a steering module that is selected to match the diameter of the product casing to be installed. The steering module is attached to a first support casing having a hollow internal auger in such a way that the operator can tilt the steering module with respect to the first support casing (as in conventional tilt steering systems), thereby steering by ground reaction forces as the support casing, steering module and cutter head are pushed by the carriage into the ground along the desired bore path. Cuttings cut by the cutter head are carried by the internal auger through the support casing back to the launch pit. When the carriage reaches the terminal point of the track, the support casing and internal conveyor are disengaged and the carriage is retracted to the start point. An additional section of support casing with an internal auger conveyor section is mounted to the carriage and attached to the support casing and conveyor sections that were disengaged from the carriage. Then the carriage is engaged to drive the steering module and support casing further in the boring direction while operating the cutter head and the internal conveyor. Multiple sections of this cutting assembly are added until the steering module reaches the target pit. Then the support casing and conveyor sections are removed, one by one, as product pipe sections of the same outer diameter are pushed by the carriage into the bore.

Some boring machines employ a laser guidance system that directs a laser beam through a component of the boring machine to a target located behind the cutter head. One such system is described in U.S. Pat. No. 3,321,248. According to this patent, a laser generator is mounted within the launch pit and arranged to direct its beam in a direction that is parallel to the boring axis of the machine. Two identical targets are mounted on the boring machine, one at the forward end behind the cutter head, and the other at the rear end. Each target comprises a plate of transparent or translucent material that is provided with grid lines, and each is mounted so that its grid lines are aligned with those of the other. When the laser beam impinges both targets at the same point with respect to the grid lines, the machine will be on course. If the laser beam does not impinge both targets at the same point, appropriate correction can be made in the boring direction by steering the machine.

U.S. Pat. No. 3,517,966 describes a laser guidance system for a boring machine which includes a sighting device comprising a luminous cross that is mounted behind the cutter head. In one embodiment of the guidance system, the image of the luminous cross is directed by a pair of mirrors disposed at 45° angles on either side of the boring axis to generate a virtual luminous cross in the plane of the cutter head. In another embodiment of this system, a laser located behind the machine directs light in the desired boring direction; however, this light is redirected by a pair of mirrors disposed at 45° angles on either side of the boring axis to impinge on a target point of a sighting device located behind the cutter head. By steering the boring machine so that the laser beam remains on the target point, its cutter head will be directed in the desired boring direction.

Another laser guidance system is described in U.S. Pat. No. 4,142,763. According to this patent, a laser generator is mounted in a tunnel retaining wall at the rear of a shield-type boring machine so that its beam is directed in the boring direction. A laser detector is mounted in the shield body for receiving the beam and for determining if the boring machine is proceeding on course. The laser detector includes an X-Y scanning type receiver having a transparent plate with a central aperture through which the beam may pass when the boring machine is on course. A gyroscopic device is attached to the opposite side of the scanning receiver along with a rolling angular detection device. The detector is mounted on a vertical threaded rod which may be rotated by a first motor to raise or lower the detector. A coupling member at the upper end of the vertical rod is attached to a horizontal threaded rod which may be rotated by a second motor to move the detector in horizontal directions along the horizontal rod. Potentiometers are attached to the threaded rods that produce voltage signals corresponding to revolutions of the rods so that the relative vertical and horizontal positions of the laser detector can be determined. The detector also includes photoelectric elements that enable the detector to determine the vertical and horizontal position of the laser beam on the receiver if it is out of alignment with the central aperture. The gyroscopic device attached to the side of the detector opposite the laser source includes lenses and electronics that can generate a signal when there is a deviation of the laser beam from that of the desired pitch and angular orientation of the shield machine. If the shield machine is off course, the propelling jacks can be selectively operated to return the machine to its proper course.

U.S. Pat. No. 5,361,854 describes a boring machine which includes at least three measuring units, each of which comprises a pair of lasers mounted back to back so that the laser beams are projected in opposite directions. Each measuring unit is mounted on the rear end of a product casing, and each includes a pair of targets, one at each end. The measuring units are mounted on adjacent product casings so that the first beam of a measuring unit impinges on the second target of an adjacent measuring unit located in one direction and the second beam of the measuring unit impinges on the first target of a measuring unit located in the opposite direction. Each target includes a photo array of light sensing elements for detecting the point of impingement of the laser beam on the target. A processor receives information about the impingement of the laser beams on the targets and calculates the direction of the bore being produced by the machine so that the steering head can be steered in the desired direction.

International Patent Publication No. WO 96/06264 describes an auger boring machine having a cutter head that includes an elongated tube portion which is supported by roller bearings within an outer pipe section. A target is mounted on the rear end of the tube portion of the cutter head. A support casing with an internal auger having a hollow shaft is mounted onto the rear end of the tube portion, so that material cut by the cutter head is carried back by the auger to a discharge point. The rear end of the hollow shaft of the auger is supported by a collar which includes a sight glass. A laser mounted behind the machine is adapted to direct a laser beam through the hollow auger to the target mounted on the rear end of the tube portion of the cutter head. A sensor rotates with the target and closes a circuit to permit laser activation only when the sensor is in the 6:00 o'clock position. If the laser beam hits the target off center, a steering system may be activated to re-align the cutter head.

U.S. Patent Publication No. 2009/0152012 describes a slurry-style microdrilling machine intended for drilling bores for pipes having diameters of 600 mm or less using a rotating cutter head assisted by ejecting pressurized fluid. This machine includes a laser guidance system and a back reamer that essentially allows for drilling of a pilot hole of a uniform diameter, followed by back reaming to enlarge the bore hole to any of several diameters. The pilot hole position is monitored by means of a laser set at the origin of the bore hole which is directed through a laser sight cavity to indicate a position on a target mounted on the cutter head.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

The use of any and all examples or exemplary language (e.g., "such as") herein is intended merely to better illuminate the invention and not to place a limitation on the scope of the invention, unless otherwise indicated by the claims. Nothing in the specification should be construed as indicating any non-claimed element as essential to the practice of the invention.

Various terms are specifically defined herein. These terms are to be given their broadest possible construction consistent with such definitions, as follows:

The term "boring direction", when used in describing the operation of a boring machine or the relative position of a component of a boring machine, refers to the direction of advance of the cutter head of the machine as the boring operation is carried out.

The terms "front" and "front end" of the boring machine refer to the end of the machine that leads in the boring direction. When referring to a component of the boring machine, the terms "front" and "front end" refer to that portion of the component that is nearer the front end of the boring machine.

The terms "rear" and "rear end" of the boring machine refer to the end opposite the front end. When referring to a component of the boring machine, the terms "rear" and "rear end" refer to that portion of the component that is nearer the rear end of the boring machine.

The terms "forward" and "in front of", as used herein to describe a relative position or direction on or in connection with a boring machine, refer to a relative position towards the front end of the machine or towards the boring direction.

The terms "rearward", "behind" and "rearwardly", as used herein to describe a relative position or direction on or in connection with a boring machine, refer to a relative position or direction towards the rear end of the machine or opposite the boring direction.

The term "linear actuator" refers to an electric, hydraulic or electro-hydraulic device that generates force which is directed in a straight line. One common example of a "linear actuator" is a hydraulic actuator which includes a cylinder, a piston within the cylinder, and a rod attached to the piston. By increasing the pressure within the cylinder on one side of the piston (over that on the opposite side of the piston), the rod will extend from the cylinder or retract into the cylinder.

The terms "product casing", "product casing component", "product casing section" and similar terms refer to a section of pipe or other product that is installed or intended to be installed in a bore. The term "product casing" may also refer to a plurality of sections of pipe or other product or product casing components that are joined, or intended to be joined, together. The term "differently-sized product casings" refers to product casings having different inside diameters and/or outside diameters. The terms "a selected one of the product casings", "selected product casings" and similar terms refer to a product casing having an inside diameter that is selected for installation within a particular bore. The term "corresponds" and similar terms, when used to compare a diameter or other dimension of a component of the auger boring machine with a similar dimension of "a selected one of the product casings", refers to the suitability of the component having such dimension for use in installing the "selected one of the product casings".

The terms "internal casing", "internal casing component", "internal casing section" and similar terms refer to a section of the portion of the boring machine that is adapted to include an auger section which is adapted to rotate with respect to the internal casing. The term "internal casing" may also refer to a plurality of sections of internal casing or internal casing components that are joined, or intended to be joined, together.

SUMMARY OF THE INVENTION

The invention comprises a boring machine which is adapted to bore a tunnel between a launch pit and a target pit and simultaneously install one of a plurality of differently-sized product casings in the tunnel. The boring machine includes a cutter head and a steering head that is located behind the cutter head and adapted to change the direction of the cutter head as boring is carried out. The boring machine also includes an internal casing having an outside diameter which is less than the inside diameter of all of the differently-sized product casings that can be installed using the machine. The internal casing is adapted to be placed within a selected one of the product casings with its longitudinal axis coincident with the longitudinal axis of the selected product casing, thereby forming an annular space with respect to the selected product casing. An adjustable support assembly is adapted to be located between the outside surface of the internal casing and the inside surface of each of the product casings for maintaining the coincidence of the internal casing longitudinal axis with the product casing longitudinal axis. The boring machine also includes a guidance assembly comprising a laser that is mounted behind the boring machine and oriented so as to direct its beam in a direction that is parallel to the desired boring direction within the annular space. A target mount is mounted to the inside surface of the steering head. The target mount includes a roll correction slot which is parallel to the adjacent steering head inside surface. A target is mounted to the target mount and adapted to move with respect to the target mount along an arc of correction which is parallel to the adjacent steering head inside surface. The target has a target point which is intersected by the laser beam when the cutter head is properly oriented with respect to the desired boring direction. A gradiometer is mounted to the target so as to indicate the pitch and the roll orientation of the steering head, and a roll correction assembly is provided to roll the steering head in order to move the gradiometer to the desired roll orientation.

The preferred boring machine includes an auger that is located within the internal casing and adapted to rotate with respect thereto. The preferred boring machine also includes a rotational mechanism that is operationally connected to the auger, so that as the auger is rotated, material within the internal casing will be conveyed towards the rear end of the auger. A pusher mechanism is provided to advance the product casing, internal casing and auger along a boring direction.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which:

FIG. 3 also shows a first-sized cutting head and product casing in solid lines, and the outline for a second-sized cutting head and product casing in broken lines.

DESCRIPTION OF THE PREFERRED EMBODIMENTS OF THE INVENTION

Figure 1:
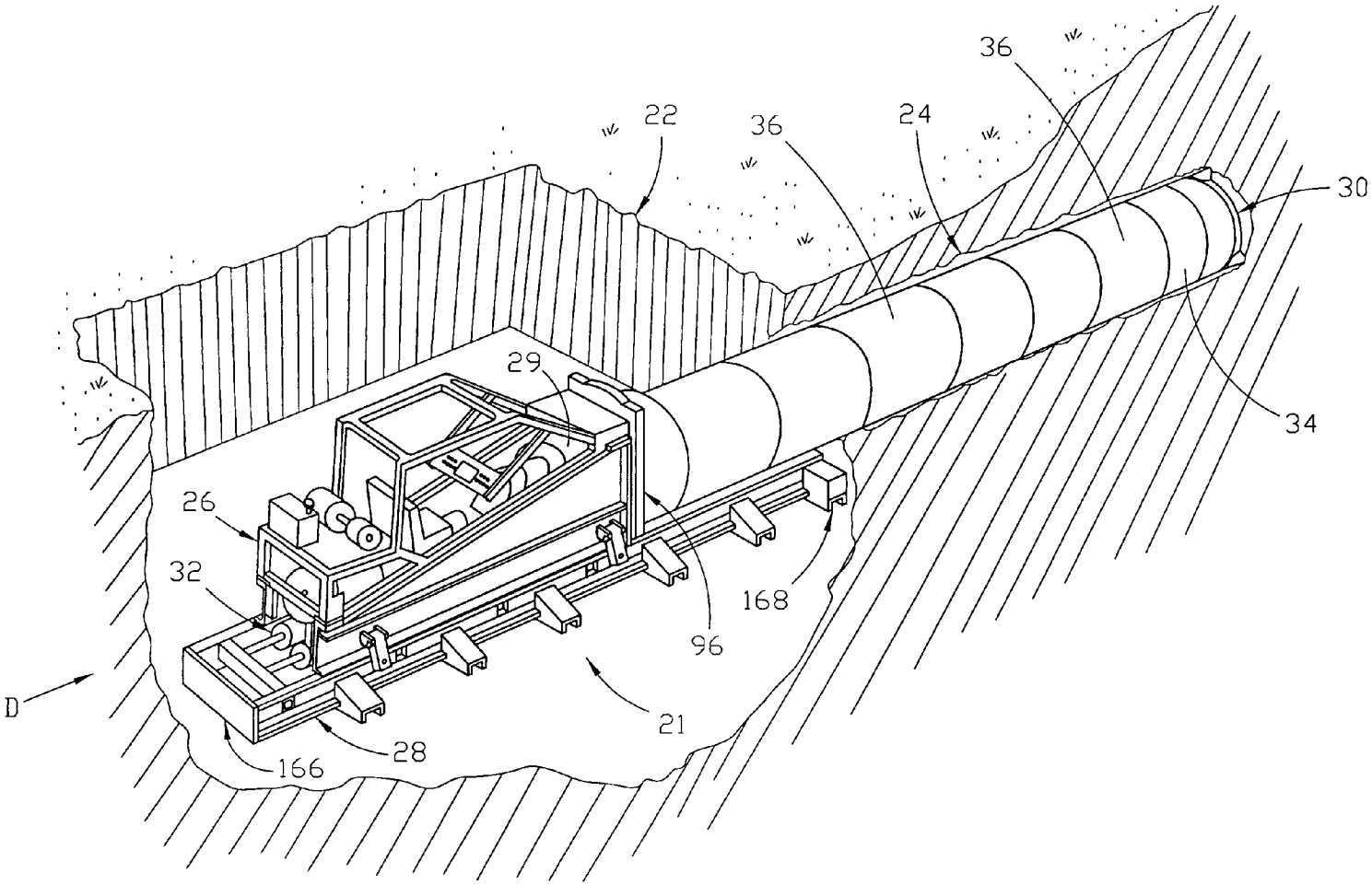
FIG. 1 is a perspective view of a boring machine constructed according to a preferred embodiment of the invention, showing the machine in a launch pit with the boring operation having been commenced.

Referring now to FIG. 1, boring machine 21, comprising a preferred embodiment of the invention, is located in launch pit 22 and is shown as it would appear in the process of boring tunnel 24. Boring machine 21 includes carriage 26 which is mounted on and adapted to move along track 28 in boring direction D. The carriage includes conventional rotational mechanism 29 for operating a selected one of a plurality of cutter heads, such as cutter head 30, and conventional pusher mechanism 32 for pushing or driving the carriage along the track.

Boring machine 21 also includes a plurality of steering heads, including steering head 34, and is intended for use in simultaneously boring a tunnel and installing any of a plurality of product casings of various sizes, including product casing 36 (shown in solid lines in various drawings) and alternative product casing 38 (shown in dashed lines in FIG. 3), in the tunnel. Each product casing of a particular size, such as product casing 36, that is installed in a tunnel is comprised of a number of product casing components that are joined together end to end. Each cutter head and steering head is selected to correspond to the diameter of the tunnel to be bored and to the diameter of the selected product casing to be installed. Preferably, the steering head is welded to the front end of the first product casing section and the cutter head is welded to the front end of the steering head.

Figure 3:
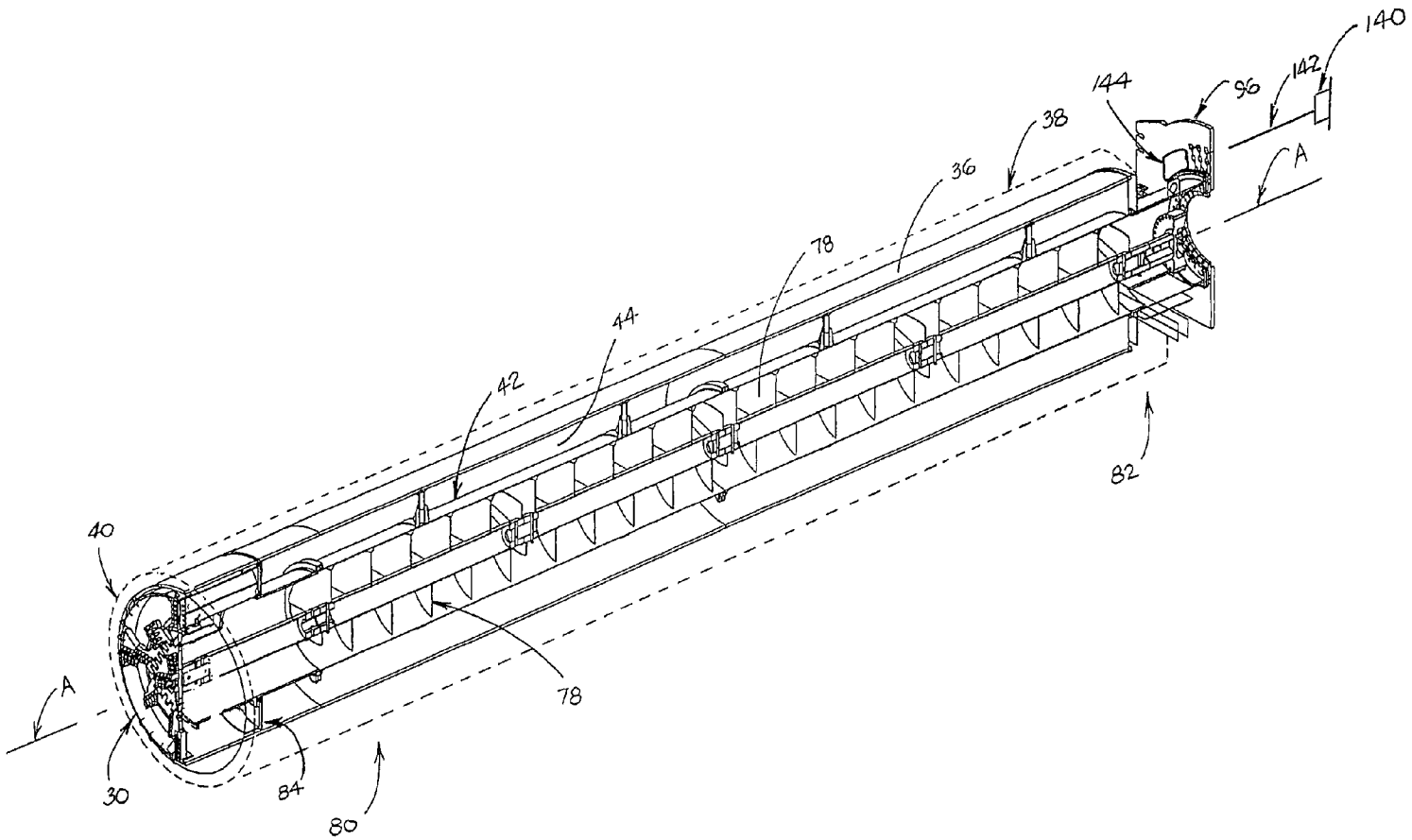
FIG. 3 is a sectional view of a portion of the boring machine of FIG. 2, taken along the line 3-3 of FIG. 2, but modified to show a portion of the cutter head and an intact product casing.

FIG. 3 also shows (in broken lines) alternative cutter head 40, along with cutter head 30. Thus, the preferred boring machine includes a plurality of sets of cutter heads and steering heads for use in connection with a plurality of differently-sized product casings. The outside diameter of the cutter head and steering head in each set corresponds to the outside diameter of the selected product casing to be installed. Each of the product casings has a product casing longitudinal axis A (shown in FIG. 3), a product casing outside diameter such as outside diameter $OD_{36}$ of product casing 36 (shown in FIG. 4), a product casing inside diameter such as product casing inside diameter $ID_{36}$ of product casing 36, and a product casing inside surface, such as product casing inside surface $S_{36}$ of product casing 36.

Figure 2:
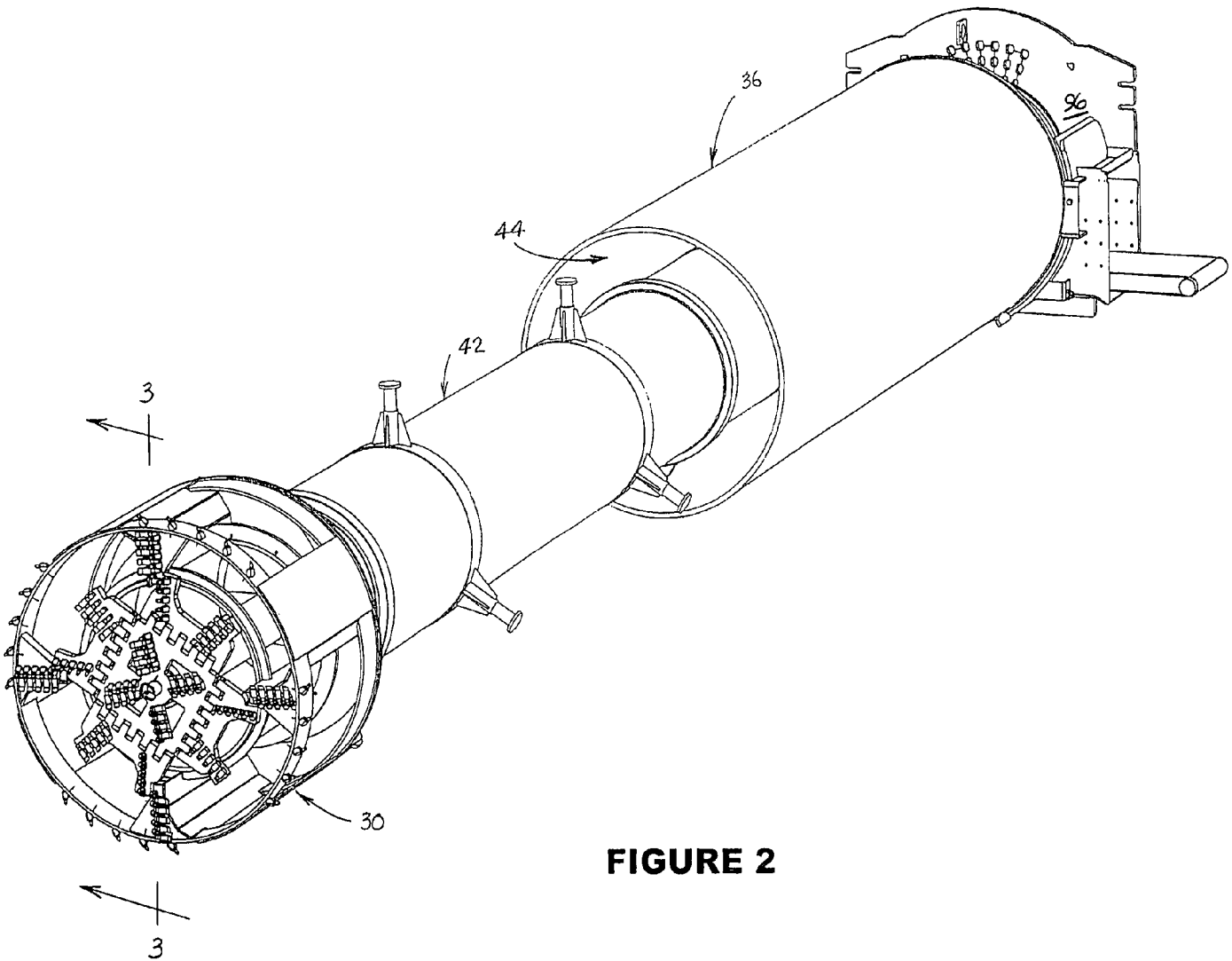
FIG. 2 is a partial perspective view of the boring machine of FIG. 1, showing a cutter head, a portion of a product casing, an internal casing and an adjustable support assembly.

The boring machine also includes internal casing 42 (not shown in FIG. 1) having an outside diameter $OD_{42}$ which is less than the inside diameter of all of the product casings that can be installed using the machine. Preferably, internal casing outside diameter $OD_{42}$ is no more than about 60% of the product casing inside diameter of the product casing having the smallest product casing inside diameter. Internal casing 42 is adapted to be placed within a selected one of the product casings (or the selected product casing placed over internal casing 42) so that the internal casing longitudinal axis coincides with longitudinal axis A of the selected product casing. In this way, regardless of which product casing size is selected, an annular space, such as space 44 shown in FIGS. 2-4, will be formed between outside surface $S_4$, of internal casing 42 and the inner surface of the product casing. Hydraulic lines, cables and wiring for the cutter head and steering head (not shown in the drawings) are placed within this annular space and protected from contact with the tunnel walls and from contact with material cut by the cutter head as boring is carried out. Furthermore, a laser guidance system for the steering assembly (described in more detail hereinafter) operates within the annular space, where it will also be protected.

Figure 4:
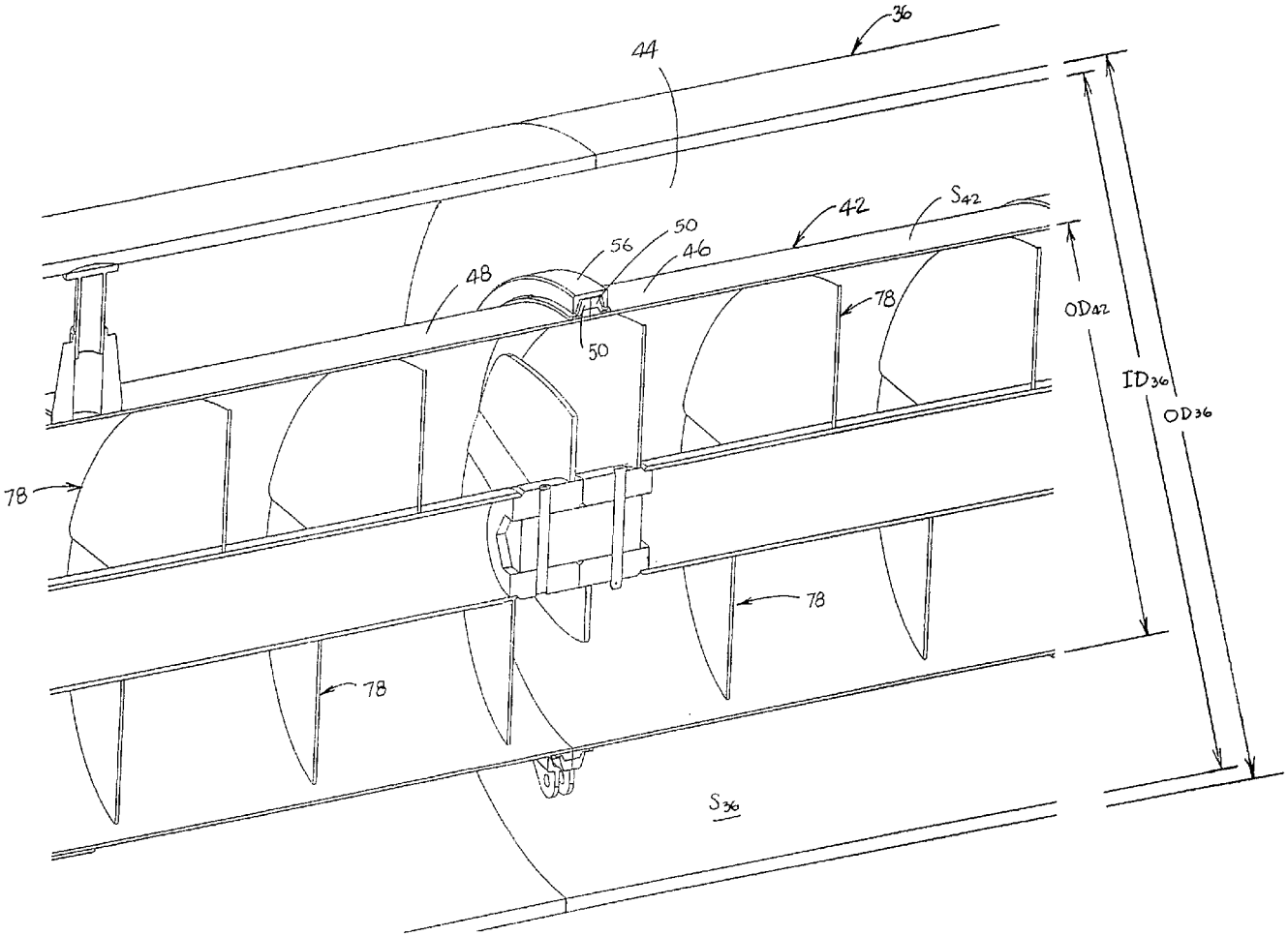
FIG. 4 is a detailed view of a portion of the boring machine of FIG. 3, showing an internal casing joint between a pair of internal casing components of a preferred embodiment of the invention.
Figure 6:
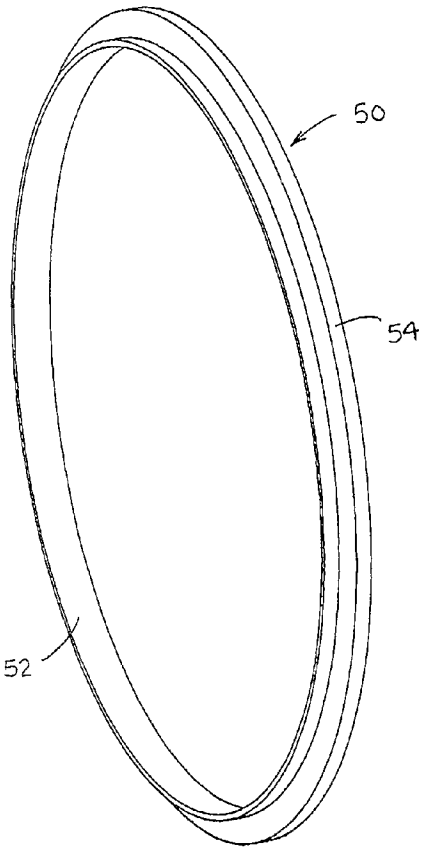
FIG. 6 is a perspective view of the end flange of FIG. 5.
Figure 5:
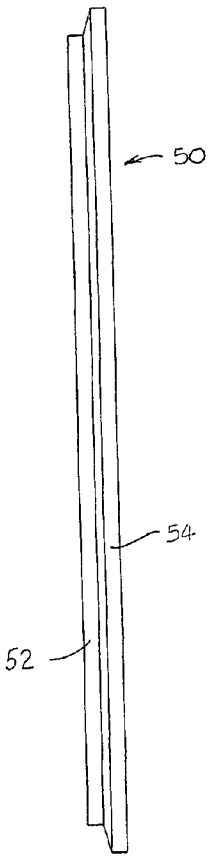
FIG. 5 is a side view of an end flange of a preferred embodiment of the invention.
Figure 7:
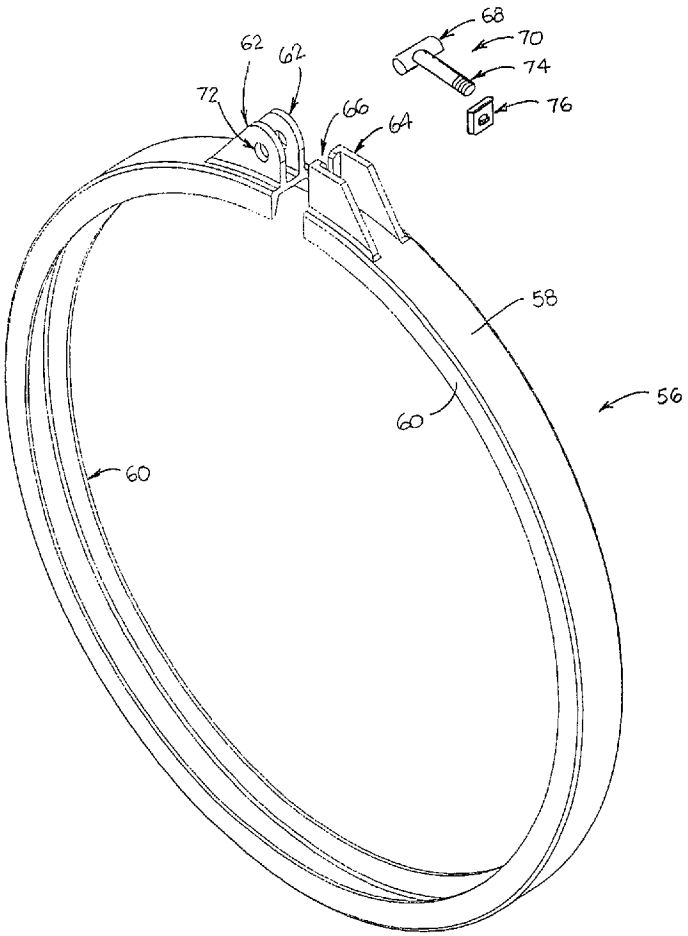
FIG. 7 is a perspective view of a clamp of a preferred embodiment of the invention.

Preferably, the internal casing comprises a plurality of internal casing components that are joined together end to end at a plurality of internal casing joints. As best shown in FIG. 4, internal casing 42 comprises a plurality of internal casing components, including internal casing components 46 and 48. Components 46 and 48 are joined together at an internal casing joint comprising end flanges 50 mounted to adjacent ends of adjacent internal casing components 46 and 48. As best shown in FIGS. 4-7, each end flange includes band portion 52 that is welded or otherwise secured to the outside surface of internal casing 42, and upstanding rim 54 that is adapted to be engaged by clamp 56. More particularly, each clamp 56 is adapted to encircle and engage the end flanges of adjacent internal casing components. As shown in FIG. 7, preferred clamp 56 is a band 58 having a pair of flange engagement sides 60 and a pair of ends that can be drawn together. One end includes a pair of spaced eyes 62 and the other includes engagement bracket 64 with engagement slot 66. T-shaped head 68 of bolt 70 is adapted to be received in holes 72 in spaced eyes 62, and threaded end 74 of bolt 70 extends into engagement slot 66. Nut 76 threads onto threaded end 74 of the bolt and is retained within engagement bracket 64.

The preferred boring machine also includes a material conveyor such as auger 78 that is located within the internal casing. Auger 78 has front end 80 and rear end 82, and conventional rotational mechanism 29 is operationally connected to the auger. The auger is adapted to rotate with respect to internal casing 42, so that operation of the rotational mechanism will cause the auger to convey material within the internal casing towards rear end 82 of the auger. Simultaneously with rotation of the auger, pusher mechanism 32 drives the carriage along the track, advancing the cutter head, steering head, auger, product casing and internal casing along boring direction D.

The boring machine includes a plurality of front bulkheads, such as front bulkhead 84 (shown in FIGS. 3 and 8), each of which is adapted to be located around the internal casing behind the selected cutter head and in front of the adjacent steering head. One function of the front bulkhead is to insure that material cut by the cutter head does not get into annular space 44 between outside surface $S_{42}$ of internal casing 42 and the inner surface of the steering head or the product casing.

Figure 8:
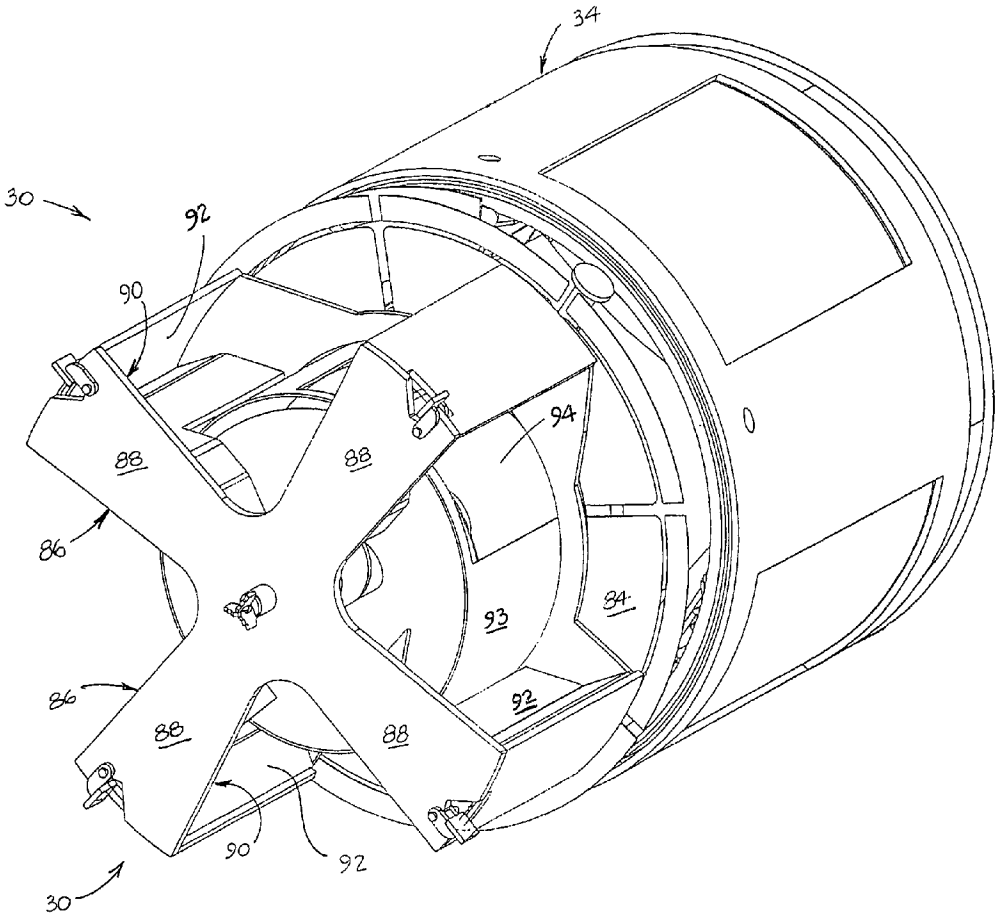
FIG. 8 is a perspective view of a portion of the boring machine of FIG. 2, showing the details of a cutter head assembly and a portion of a steering head of a preferred embodiment of the invention.
Figure 9:
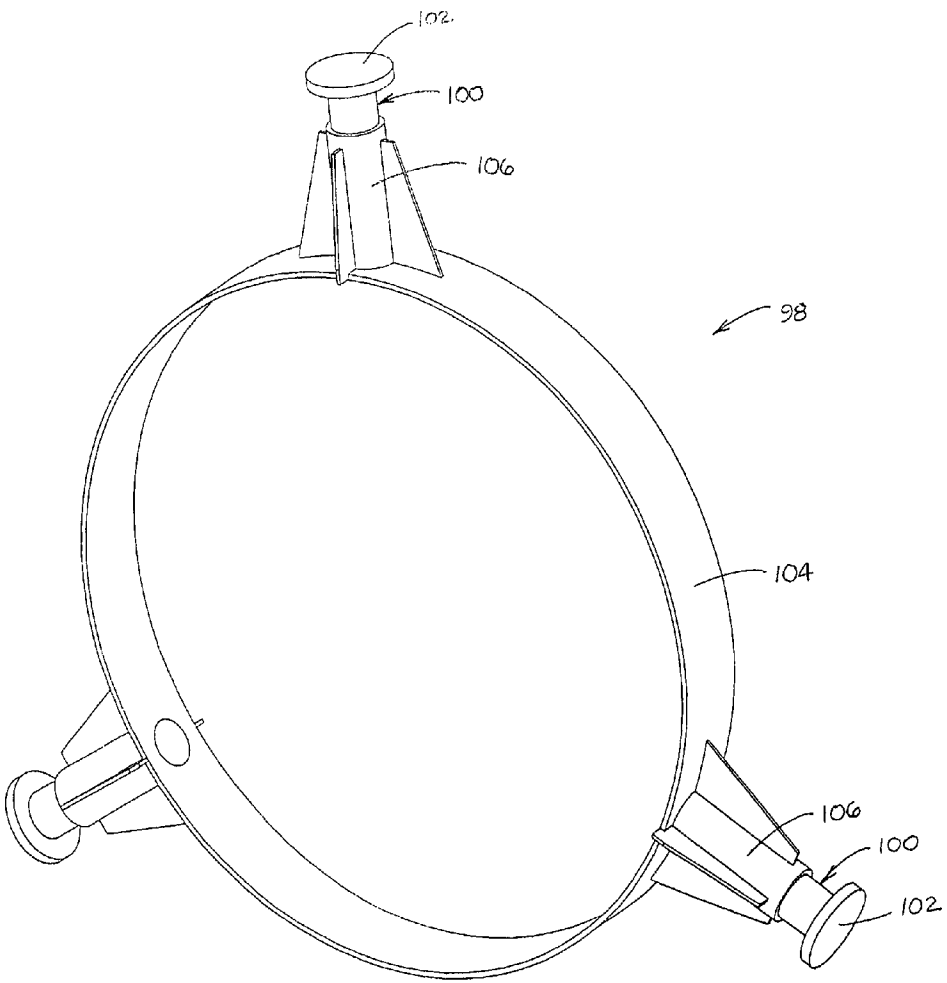
FIG. 9 is a perspective view of an adjustable support assembly of a preferred embodiment of the invention.

The preferred boring machine also includes means for directing material cut by the selected cutter head into the internal casing so that rotation of the auger will convey such material towards the rear end of the auger within the internal casing. As best shown in FIG. 8, cutter head 30 includes a plurality of cutter blades 86, each of which has front side 88 and rear side 90. The cutter blades are operationally attached to the auger, either directly or through a linkage mechanism, so that rotation of the auger will also rotate the cutter blades. In this embodiment of the invention, the means for directing material cut by the cutter blades of the selected cutter head into the internal casing comprises a plurality of collecting buckets 92, each of which is mounted on the rear side of a cutter blade. These collecting buckets sweep material cut by the cutter blades into hopper 93 through hopper opening 94 as the cutter blades rotate. Hopper 93 is an extension of internal casing 42 and includes front end 80 of auger 78.

Figure 10:
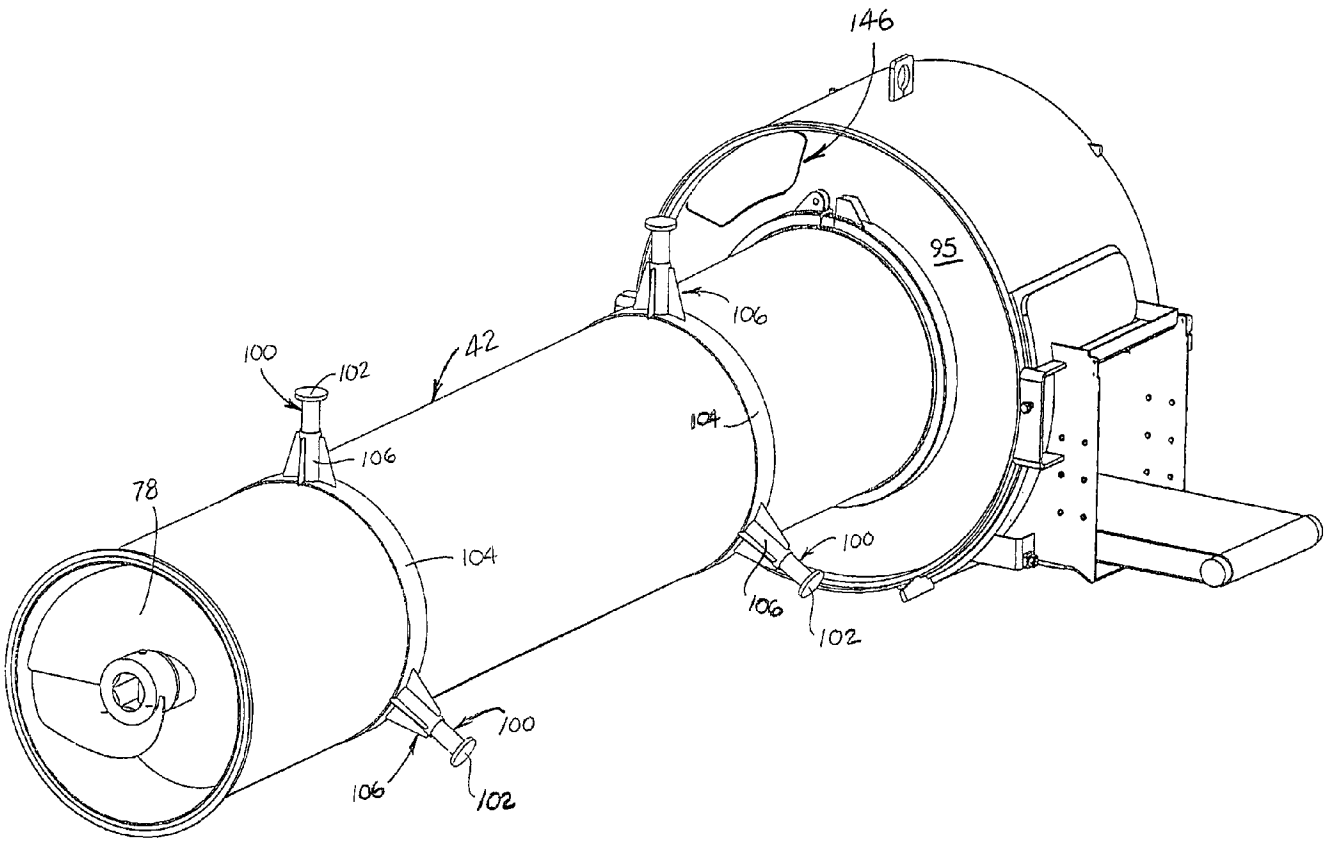
FIG. 10 is a partial perspective view of a portion of the boring machine of FIG. 2, with the cutter head, steering head and product casing removed.

The preferred boring machine also includes a plurality of rear bulkheads, such as rear bulkhead 95 (shown in FIG. 10), each of which is adapted to be located between the inside surface of a selected one of the product casings and outside surface $S_{42}$ of internal casing 42 near rear end 82 of auger 78. Rear bulkhead 95 is also located in front of carriage bulkhead 96 (shown in FIGS. 1-3), which is located at the front end of carriage 26.

The preferred boring machine also includes an adjustable support assembly that is adapted to be located between outside surface $S_{42}$ of internal casing 42 and the inside surface of each of the product casings (and, optionally, each corresponding steering head) for maintaining the coincidence of the internal casing longitudinal axis with the product casing longitudinal axis. Preferred adjustable support assembly 98 comprises a plurality of internal casing support legs 100 that are spaced around the periphery of the internal casing and along its length. Each support leg 100 includes a bearing pad 102 that is adapted to bear against the inside surface of the product casing (or steering head), such as against product casing inside surface $S_{36}$ of product casing 36. Adjustable support assembly 98 also includes internal support band 104 that is disposed around the periphery of the internal casing and welded or otherwise affixed thereto. Adjustable support assembly 98 also includes a plurality of leg supports 106, each of which is adapted to cooperate with an internal casing support leg 100 in the preferred adjustable support assembly. Preferably, each of internal casing support legs 100 is provided with external threads and each cooperating leg support 106 is provided with corresponding internal threads, so that the length of the portion of each support leg 100 that extends from its corresponding leg support 106 can be adjusted, by threading the support leg into or out of the leg support, depending on the inside diameter of the product casing, such as product casing inside diameter $ID_{36}$ of product casing 36.

Figure 11:
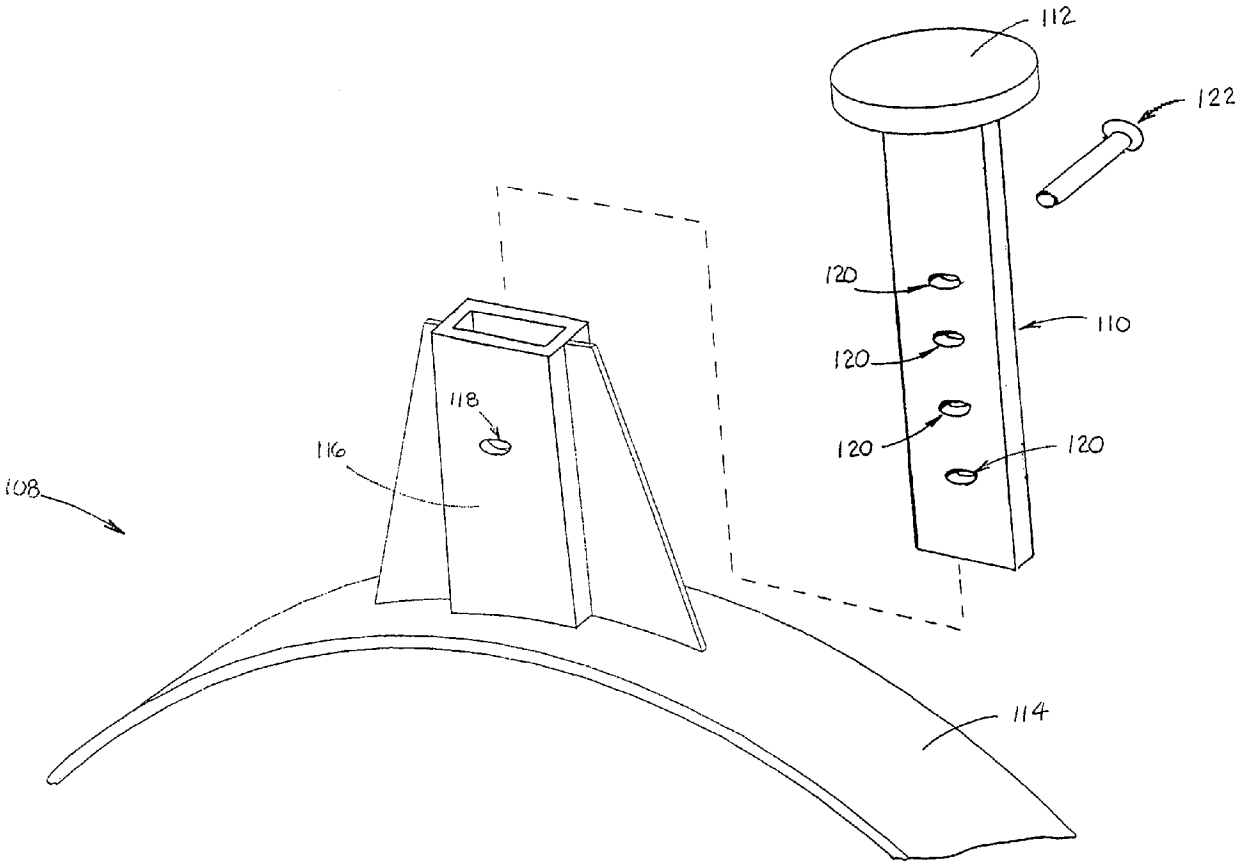
FIG. 11 is a partial perspective view of an alternative internal casing support leg and leg support of an adjustable support assembly.

In another embodiment of the adjustable support assembly, each internal casing support leg is in adjustable telescoping relationship with an associated leg support so that the length of the corresponding support assembly may be varied. Each adjustable support assembly 108 of this embodiment, like that of adjustable support assembly 98, comprises a plurality of internal casing support legs that are spaced around the periphery of the internal casing and along its length. As shown in FIG. 11, each support leg 110 of this embodiment includes a bearing pad 112 that is adapted to bear against the inside surface of the product casing (or the steering head), such as against product casing inside surface $S_{36}$ of product casing 36. Adjustable support assembly 108 also includes internal support band 114 that is disposed around the periphery of the internal casing and welded or otherwise affixed thereto. Adjustable support assembly 108 also includes a plurality of leg supports 116, each of which is adapted to cooperate with an internal casing support leg 110 to comprise a support assembly. In this embodiment of the invention, leg support 116 is provided with adjustment hole 118, and support leg 110 is provided with a plurality of adjustment holes 120, so that support leg 110 may be telescoped within leg support 116 between a plurality of positions, each of which aligns an adjustment hole 120 with adjustment hole 118 so that attachment pin 122 may be placed through the holes to secure the support leg to the leg support. Of course, it is also contemplated within the scope of the invention that the internal casing support leg may be provided with a single adjustment hole (not shown) and the associated leg support provided with a plurality of adjustment holes (also not shown), each of which is adapted to receive the attachment pin. In either configuration of this embodiment of the invention, the internal casing support leg and associated leg support are arranged and configured so that the adjustment holes on each component may be aligned in a plurality of configurations, each of which corresponds to a support assembly length that is determined by the inside diameter of the selected product casing.

Figure 12:
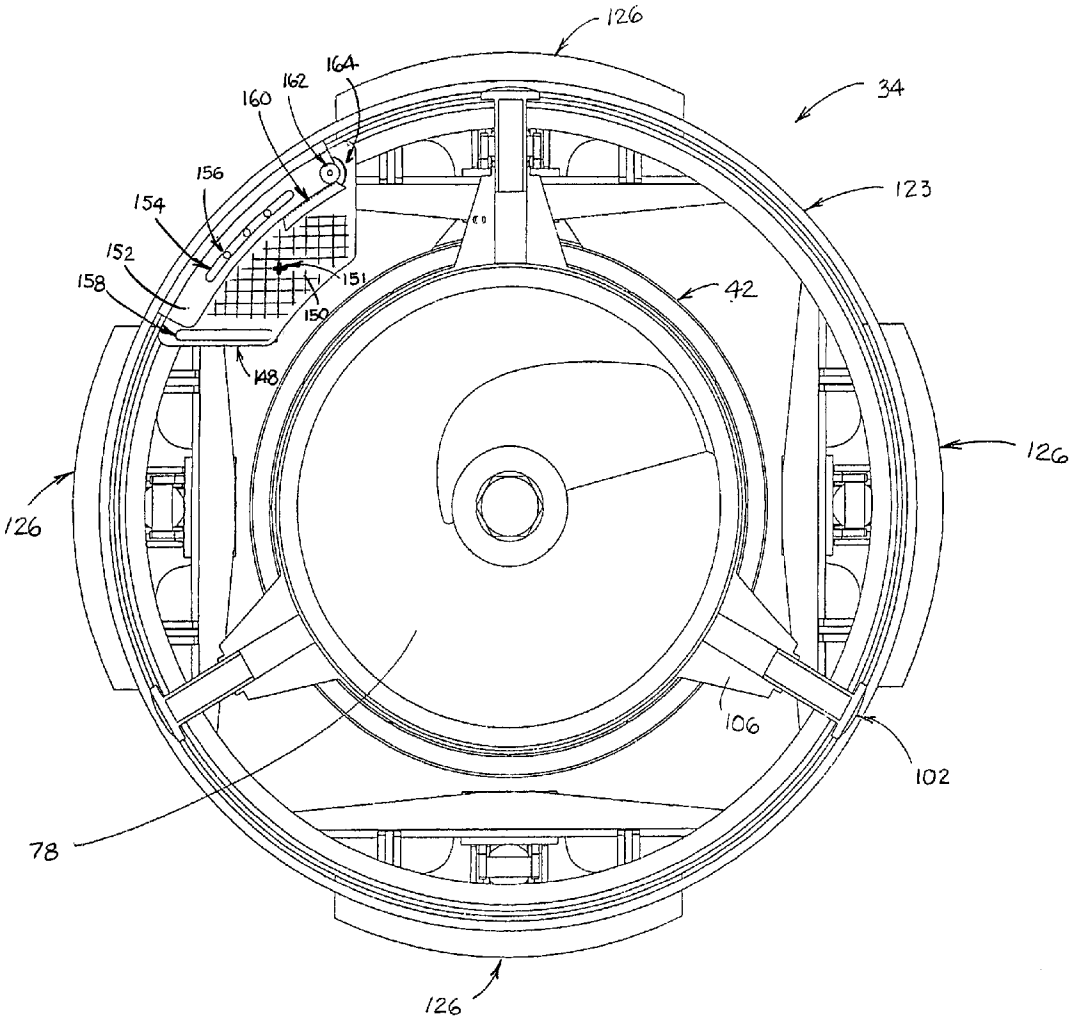
FIG. 12 is a front view of a portion of the boring machine of FIG. 1, with the cutter head removed.
Figure 13:
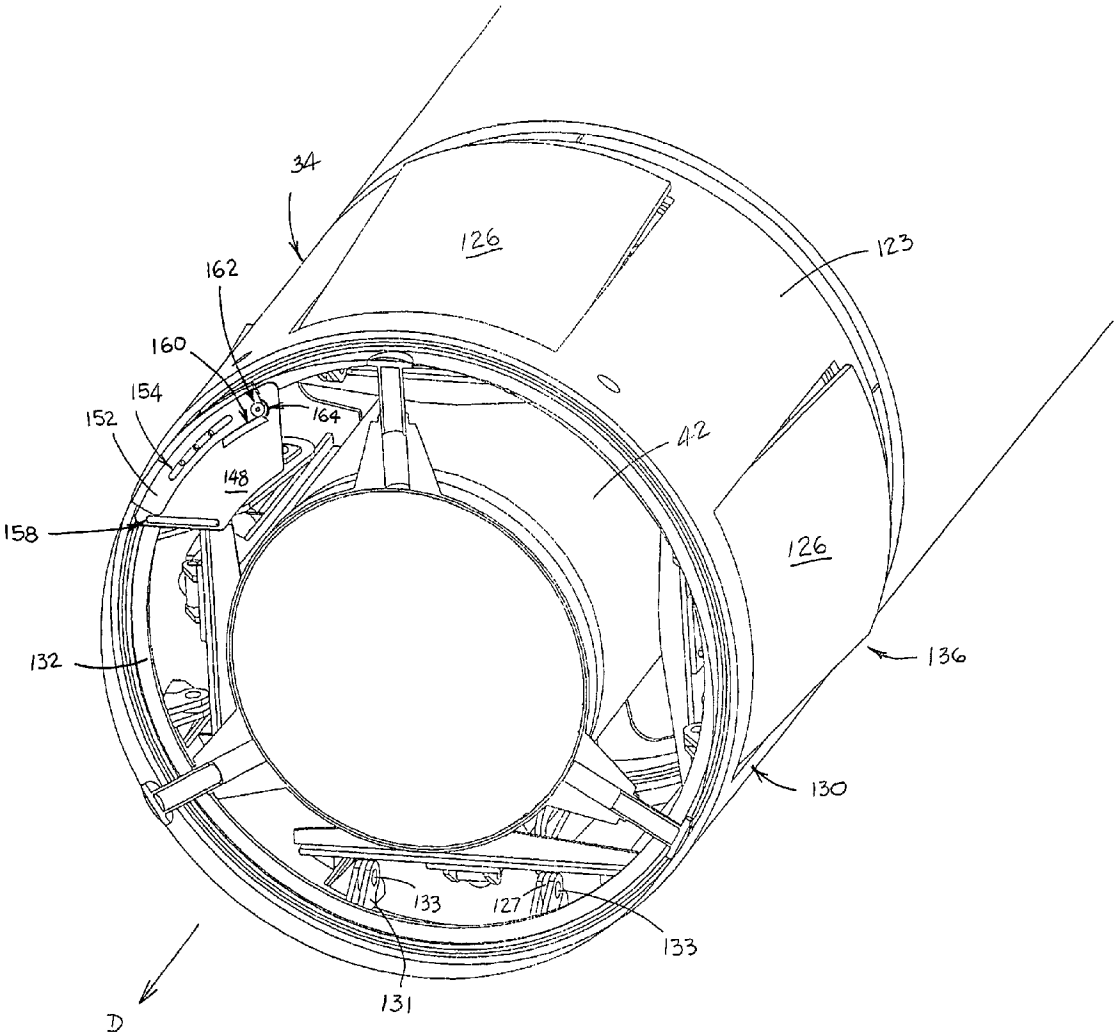
FIG. 13 is a partial perspective view of a portion of the boring machine of FIG. 12 showing the steering head and with the auger removed.

The steering head is selected to correspond to the product casing to be installed using the boring machine. The selected steering head, such as steering head 34, is located behind a selected one of the cutter heads, such as cutter head 30, and is adapted to be employed by an operator to change the direction of the cutter head. As shown in FIGS. 12 and 13, steering head 34 is adapted to receive the front end of internal casing 42. Furthermore, the steering head has a steering head longitudinal axis that is coincident with the internal casing longitudinal axis and with longitudinal axis A (see FIG. 3) of the selected product casing. Steering head 34 includes housing 123 with a plurality of steering openings spaced around its periphery. Preferably, housing 123 of steering head 34 has four steering openings 124 spaced at 90° intervals around its periphery. A plurality of steering components are provided, each of which is mounted within the steering head adjacent to a steering opening. Each steering component includes a steering paddle 126 that includes a pair of paddle brackets 127 at its front end 130. The paddle brackets cooperate with a pair of pivot brackets 131 that are mounted to housing 123 and support ring 132 located in the front end of steering head 34, and with a pair of pivot pins 133, so that the steering paddle can pivot to move its rear end 136 out of or into steering opening 124. The preferred steering assembly of boring machine 21 includes a linear actuator (not shown) that may be operated to generate a pivot force to move rear end 136 of steering paddle 126 through steering opening 124 to bear against the walls of the bore, thereby causing a reaction force that will change the direction of boring of machine 21. Of course, two or more steering components may be operated at the same time to change the direction of the boring machine.

The guidance assembly for boring machine 21 includes laser 140 (shown schematically in FIG. 3), which is mounted behind the boring machine in the launch pit, and oriented so as to direct its beam 142 in a desired boring direction through window 144 in carriage bulkhead 96, through window 146 in rear bulkhead 95 (shown in FIG. 10), and through annular space 44 to target 148 (shown in FIGS. 12 and 13). Target 148 is provided with a grid pattern 150 (not shown in FIG. 13) which assists an operator in keeping the laser beam on target so as to intersect a target point such as target point 151 in a direction that is parallel to boring direction D. By selecting a target point which is intersected by the laser beam when the cutter head is properly oriented with respect to the desired boring direction, an operator can cause one or more steering paddles 126 to move through steering opening 124 to bear against the walls of the bore, thereby causing a reaction force that will change the direction of boring of machine 21, if necessary.

Target mount 152 is mounted to the inside surface of steering head 34 behind front bulkhead 84. The target mount includes roll correction slot 154 which is parallel to the adjacent inside surface of steering head 34. Slot 154 comprises an arc of correction for use in correcting the roll of the steering head during boring. Target 148 is mounted to the target mount by means of roller guides 156 which pass through slot 154. The cooperation of roller guides 156 and slot 154 allows target 148 to be moved along the arc of correction with respect to target mount 152. Attached to target 148 is gradiometer 158 which is adapted to indicate the pitch and the roll orientation of steering head 34. If the pitch of the steering head has moved the steering head off course, the steering assembly can be employed to make a desired course correction.

If the steering head rolls during boring, as indicated by the gradiometer, a roll correction assembly can be employed to restore a desired roll orientation. The roll correction assembly includes rack 160 that is mounted on the target so as to be generally parallel with the inside surface of steering head 34, and pinion 162 that is mounted through the target mount and in engagement with the rack. Motor 164 is mounted to the pinion and adapted to rotate it, so that as the pinion rotates, target 148 can be moved along the arc of correction to the desired roll orientation.

To begin the boring of a tunnel in a desired boring direction and the simultaneous installation of a selected product casing, a launch pit and a target pit are excavated. Track 28 is placed in the launch pit and oriented in the desired boring direction D towards the target pit. Carriage 26 is then mounted on the track in the launch pit. A product casing is selected from the differently-sized product casings that may be installed using the boring machine, and a cutter head is selected so as to have a cutter head diameter which corresponds to the product casing outside diameter of the selected product casing. The selected product casing is installed over the internal casing and the adjustable support assembly is adjusted to maintain the coincidence of the internal casing longitudinal axis with the product casing longitudinal axis of the selected product casing. The selected cutter head is attached to the front end of the auger, and the pusher mechanism is operated to move the carriage from initial end 166 of track 28 to terminal end 168, thereby advancing the selected cutter head, the selected product casing, the auger and the internal casing in the desired boring direction, while the rotational mechanism is simultaneously operated to rotate the auger and the cutter blades. When the carriage reaches terminal end 168 of the track, the rotational mechanism and the pusher mechanism are stopped, and the selected product casing, the auger and the internal casing are disengaged from the carriage. The carriage is then retracted from the terminal end of the track to the initial end of the track, leaving the selected product casing, internal casing and auger in the bore. An additional adjustable support assembly is mounted to an additional section of internal casing, an additional section of auger is placed within the additional section of internal casing, and an additional section of the selected product casing is placed over the internal casing and auger, so that the additional adjustable support assembly maintains the coincidence of the internal casing longitudinal axis with the product casing longitudinal axis. The additional sections of product casing, internal casing and auger are placed on the track in front of the carriage, and the front ends of the additional section of the selected product casing, the additional section of the internal casing and the additional section of the auger are attached to the rear ends of the casing and conveyor sections that were disengaged from the carriage. The rear end of the additional section of the auger is attached to the rotational mechanism, and the rear ends of the additional section of the selected product casing, the additional section of the internal casing and the additional section of the auger are attached to or engaged by the pusher mechanism. The carriage is then moved by operation of the pusher mechanism to advance the selected cutter head, the selected product casing, the auger and the internal casing from the initial end of the track to the terminal end while operating the rotational mechanism to rotate the auger and the cutter head. These steps are then repeated until the selected product casing reaches the target pit.

When the product casing reaches the target pit, the cutter head is removed from the assembly and the steering head is detached from the first product casing section. The internal casing and auger sections may then be removed, leaving the product casings in the bore. In one method of operating the invention, the carriage is employed to pull the internal casing and auger sections backwardly to the launch pit, where they are removed, one by one. In another method of operation, an alternative driving mechanism is placed in the target pit and employed to pull the internal casing and auger sections forwardly out of the product casing into the target pit.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A boring machine for boring a tunnel from a launch pit to a target pit along a desired boring direction and simultaneously installing a selected one of a plurality of differently-sized product casings in the tunnel, in which each product casing of a selected size has a product casing longitudinal axis, a product casing inside surface, a product casing outside diameter and a product casing inside diameter, wherein the boring machine comprises:

(a) an internal casing:

(i) having an internal casing longitudinal axis;

(ii) having an internal casing outside surface;

(iii) having an internal casing outside diameter which is less than all of the product casing inside diameters of the differently-sized product casings that may be installed using the boring machine;

(iv) which is adapted to be placed within a selected one of the product casings with its internal casing longitudinal axis coincident with the longitudinal axis of the selected product casing, thereby forming an annular space with respect to the selected product casing;

(b) an adjustable support assembly that is adapted to be located between the outside surface of the internal casing and the inside surface of the selected one of the differently-sized product casings for maintaining the coincidence of the internal casing longitudinal axis with the product casing longitudinal axis;

(c) an auger which:

(i) has a front end;

(ii) has a rear end;

(iii) is located within the internal casing and adapted to rotate with respect thereto;

(iv) is adapted to convey material towards its rear end as it is rotated;

(d) a rotational mechanism which is operationally connected to the auger;

(e) a pusher mechanism which is adapted to advance the selected product casing, the internal casing and the auger;

(f) a plurality of cutter heads, each of which:

(i) has a plurality of cutter blades which are attached to the front end of the auger;

(ii) has a cutter head diameter which corresponds to the product casing outside diameter of the selected product casing;

(g) which includes means for directing material cut by the cutter blades into the internal casing so that rotation of the auger will convey such material towards the rear end of the auger within the internal casing;

(h) a front bulkhead that is located behind the cutter head;

(i) a steering head that is operated to change the direction of the cutter head, said steering head having an inside surface;

(j) a guidance assembly comprising:

(i) a laser that is mounted behind the boring machine and oriented so as to direct its beam in a direction that is parallel to a desired boring direction within the annular space;

(ii) a target mount which is mounted to the steering head inside surface behind the front bulkhead, said target mount including a roll correction slot comprising an arc of correction which is parallel to the adjacent steering head inside surface;

(iii) a target which is mounted to the target mount and adapted to move with respect thereto along the arc of correction, said target having a target point which is intersected by the laser beam when the cutter head is properly oriented with respect to the desired boring direction;

(iv) a gradiometer which is mounted to the target so as to indicate the roll orientation of the steering head;

(v) a roll correction assembly that is adapted to roll the steering head in order to move the gradiometer to a desired roll orientation.

2. The boring machine of claim 1 wherein the gradiometer is adapted to indicate the pitch of the steering head.

3. The boring machine of claim 1 wherein:

(a) the target is mounted to the target mount by means of a plurality of roller guides that pass through the roll correction slot;

(b) the roll correction assembly comprises:

(i) a rack that is mounted on the target so as to be generally parallel with the steering head inside surface;

(ii) a pinion that is mounted through the target mount and in engagement with the rack;

(iii) a motor that is mounted to the pinion and adapted to rotate it;

wherein operation of the motor will cause the pinion to rotate, thereby moving the target along the arc of correction.

4. The boring machine of claim 1 which includes:

(a) a track;

(b) a carriage that is mounted on the track, said carriage including the pusher mechanism and being adapted to be moved thereby along with the product casing with respect to the track.

5. The boring machine of claim 1 wherein the steering head comprises:

(a) a plurality of steering openings near its front end;

(b) a plurality of steering assemblies, each of which is adapted to apply a steering force through a steering opening.

6. The boring machine of claim 1:

(a) wherein the cutter head includes a front hopper;

(b) wherein the auger extends into the front hopper.

7. The boring machine of claim 6 wherein:

(a) each of the cutter blades has a front side and a rear side;

(b) the means for directing material cut by the cutter blades into the internal casing comprises a plurality of collecting buckets, each of which is mounted on the rear side of a cutter blade, which collecting buckets sweep material cut by the cutter blades into the auger in the front hopper as the cutter head rotates.

8. The boring machine of claim 1 wherein the adjustable support assembly comprises a plurality of internal casing support legs spaced around the periphery of the internal casing.

9. The boring machine of claim 8 which includes an internal support band:

(a) that is disposed around the periphery of the internal casing;

(b) to which the internal casing support legs are attached;

(c) that includes a plurality of leg supports, each of which is adapted to cooperate with a internal casing support leg.

10. The boring machine of claim 9 wherein each internal casing support leg is in adjustable telescoping relationship with an associated leg support so that the length of the corresponding support assembly may be varied.

11. The boring machine of claim 10 wherein for each support assembly:

(a) an attachment pin is provided;

(a) one oldie internal casing support leg and associated leg support is provided with a plurality of adjustment holes, each of which is adapted to receive the attachment pin;

(b) the other of the internal casing support leg and associated leg support is provided with an adjustment hole that is adapted to receive the attachment pin;

wherein the internal casing support leg and associated leg support are arranged and configured so that the adjustment holes on each such component may be aligned in a plurality of configurations, each of which corresponds to a support assembly length, and so that the attachment pin may be placed therethrough to secure the internal casing support leg and associated leg support.

12. The boring machine of claim 1 wherein the internal casing comprises a plurality of internal casing components that are joined together end to end at a plurality of internal casing joints, wherein each such internal casing joint comprises:

(a) an end flange mounted to adjacent ends of adjacent internal casing components;

(b) a clamp that is adapted to engage the end flanges of adjacent internal casing components.

13. The boring machine of claim 12 wherein each clamp comprises:

(a) a band that is adapted to encircle and engage the end flanges of adjacent internal casing components, said band including:

(i) a pair of flange engagement sides;

(ii) a first end having a pair of spaced eyes, each of which includes a hole;

(iii) a second end having an engagement bracket which includes an engagement slot;

(b) a bolt comprising:

(i) a T-shaped head that is adapted to be received in the holes in the spaced eyes at the first end of the band;

(ii) a threaded end that extends into the engagement slot of the engagement bracket;

(c) a nut that is adapted to engage the threaded end of the bolt and be retained within the engagement bracket.

14. A boring machine comprising:

(a) a track;

(b) a carriage that is mounted on the track, said carriage comprising:

(i) a pusher mechanism that is adapted to move the carriage along the track;

(ii) a rotational mechanism;

(c) an internal casing that is located in front of the carriage and adapted to be moved by the carriage as the pusher mechanism moves the carriage along the track;

(d) an auger which:

(i) has a front end;

(ii) has a rear end;

(iii) has an auger longitudinal axis;

(iv) is located within the internal casing;

(v) is adapted to rotate with respect to the internal casing;

(vi) is operationally connected to the rotational mechanism of the carriage;

(v) is adapted to convey material towards its rear end as it is rotated;

(e) a cutter head having a plurality of cutter blades which are attached to the front end of the auger so as to rotate therewith;

(f) a steering head which:

(i) is adapted to be located behind the cutter head and in front of the internal casing;

(ii) has a steering head longitudinal axis that is coincident with the auger longitudinal axis;

(iii) has a steering head inside surface;

(g) a guidance assembly comprising:

(i) a laser that is mounted behind the carriage and oriented so as to direct its beam in a direction that is parallel to a desired boring direction;

(ii) a target mount which is mounted to the steering head inside surface behind the front bulkhead, said target mount including a roll correction slot comprising an arc of correction which is parallel to the adjacent steering head inside surface;

(iii) a target which is mounted to the target mount and adapted to move with respect thereto along the arc of correction, said target having a target point which is intersected by the laser beam when the cutter head is properly oriented with respect to the desired boring direction;

(iv) a gradiometer which is mounted to the target so as to indicate the roll orientation of the steering head;

(v) a roll correction assembly that is adapted to roll the steering head in order to move the gradiometer to a desired roll orientation.

15. The boring machine of claim 14 wherein:

(a) the target is mounted to the target mount by means of a plurality of roller guides that pass through the roll collection slot;

(b) the roll correction assembly comprises:

(i) a rack that is mounted on the target so as to be generally parallel with the steering head inside surface;

(ii) a pinion that is mounted through the target mount and in engagement with the rack;

(iii) a motor that is mounted to the pinion and adapted to rotate it;

wherein operation of the motor will cause the pinion to rotate, thereby moving the target along the arc of correction.

16. A method for boring a tunnel from a launch pit to a target pit along a desired boring direction and simultaneously installing a selected one of a plurality of differently-sized product casings in the tunnel, in which each product casing of a selected size has a product casing longitudinal axis, a product casing outside diameter, a product casing inside diameter and a product casing inside surface, wherein the method comprises:

(a) providing a boring machine comprising:

(i) an internal casing:

(1) having an internal casing longitudinal axis;

(2) having an internal casing outside surface;

(3) having an internal casing outside diameter which is less than all of the product casing inside diameters of the differently-sized product casings that may be installed using the boring machine;

(4) which is adapted to be placed within a selected one of the product casings with its internal casing longitudinal axis coincident with the longitudinal axis of the selected product casing, thereby forming an annular space with respect to the selected product casing;

(ii) an adjustable support assembly that is adapted to be located between the outside surface of the internal casing and the inside surface of the selected product casing for maintaining the coincidence of the internal casing longitudinal axis with the product casing longitudinal axis;

(iii) an auger which:

(1) has a front end;

(2) has a rear end;

(3) is located within the internal casing and adapted to rotate with respect thereto;

(4) is adapted to convey material towards its rear end as it is rotated;

(iv) a track having:

(1) an initial end;

(2) a terminal end;

(v) a carriage that is adapted to be mounted on the track and moved therealong, which carriage includes:

(1) a rotational mechanism which is operationally connected to the auger;

(2) a pusher mechanism which is adapted to move the carriage along the track to advance the selected product casing, the internal casing and the auger in the boring direction;

(vi) a plurality of cutter heads, each of which:

(1) has a plurality of cutter blades which are adapted to be attached to the front end of the auger;

(2) has a cutter head diameter which corresponds to the product casing outside diameter of one of the differently-sized product casings;

(vii) which includes means for directing material cut by the cutter blades into the internal casing so that rotation of the auger will convey such material towards the rear end of the auger within the internal casing;

(viii) a front bulkhead that is located behind the cutter head;

(ix) a steering head that is operated to change the direction of the cutter head, said steering head having an inside surface;

(x) a guidance assembly comprising:

(1) a laser that is mounted behind the carriage and oriented so as to direct its beam in a direction that is parallel to a desired boring direction within the annular space;

(2) a target mount which is mounted to the steering head inside surface behind the front bulkhead, said target mount including a roll correction slot comprising an arc of correction which is parallel to the adjacent steering head inside surface;

(3) a target which is mounted to the target mount and adapted to move with respect thereto along the arc of correction, said target having a target point which is intersected by the laser beam when the cutter head is properly oriented with respect to the desired boring direction;

(4) a gradiometer which is mounted to the target so as to indicate the roll orientation of the steering head;

(5) a roll correction assembly that is adapted to roll the steering head in order to move the gradiometer to a desired roll orientation;

(b) excavating a launch pit;

(c) excavating a target pit;

(d) placing the track in the launch pit and orienting it in the desired boring direction towards the target pit;

(e) mounting the carriage on the track in the launch pit;

(f) selecting a product casing from the differently-sized product casings that may be installed using the boring machine;

(g) selecting a cutter head having a cutter head diameter which corresponds to the product casing outside diameter of the selected product casing;

(h) installing the selected product casing over the internal casing;

(i) adjusting the adjustable support assembly to maintain the coincidence of the internal casing longitudinal axis with the product casing longitudinal axis of the selected product casing;

(j) attaching the selected cutter head to the front end of the auger;

(k) operating the rotational mechanism to rotate the auger and the cutter blades while operating the pusher mechanism to advance the selected cutter head, the selected product casing, the auger and the internal casing.

17. The method of claim 16 which includes:

(a) operating the pusher mechanism to move the carriage from the initial end of the track to the terminal end of the track, thereby advancing the selected cutter head, the selected product casing, the auger and the internal casing in the desired boring direction, while operating the rotational mechanism to rotate the auger and the cutter blades;

(b) stopping the operation of the rotational mechanism and the pusher mechanism;

(c) disengaging the selected product casing, the auger and the internal casing from the carriage;

(d) retracting the carriage from the terminal end of the track to the initial end of the track;

(e) providing an additional section of internal casing having a front end and a rear end;

(f) mounting an additional adjustable support assembly to the additional section of internal casing;

(g) providing an additional section of auger having a front end and a rear end;

(h) placing the additional section of auger within the additional section of internal casing with the front end of the additional section of auger adjacent to the front end of the additional section of internal casing;

(i) providing an additional section of the selected product casing having a front end and a rear end;

(j) placing the additional section of the selected product casing over the internal casing and auger with the front end of the additional section of the selected product casing adjacent to the front ends of the internal casing and auger, so that the additional adjustable support assembly maintains the coincidence of the internal casing longitudinal axis with the product casing longitudinal axis;

(k) placing the additional sections of product casing, internal casing and auger onto the track in front of the carriage;

(l) attaching the front ends of the additional section of the selected product casing, the additional section of the internal casing and the additional section of the auger to the casing and conveyor sections that were disengaged from the carriage;

(m) attaching the rear end of the additional section of the auger to the rotational mechanism;

(n) engaging the rear ends of the additional section of the selected product casing, the additional section of the internal casing and the additional section of the auger with the pusher mechanism;

(o) moving the carriage from the initial end of the track to the terminal end of the track while operating the rotational mechanism to rotate the auger and the cutter head, and while operating the pusher mechanism to advance the selected cutter head, the selected product casing, the auger and the internal casing;

(p) repeating steps (b) through (o) until the selected product casing reaches the target pit.

* * * * *

UNITED STATES PATENT AND TRADEMARK OFFICE

CERTIFICATE OF CORRECTION

PATENT NO. : 8,210,774 B1
APPLICATION NO. : 12/800669
DATED : July 3, 2012
INVENTOR(S) : David A. Vidovic and Michael W. Thomas It is certified that error appears in the above-identified patent and that said Letters Patent is hereby corrected as shown below:

In column 8, line 17, delete "S4," and insert:
--S42--

In column 14, line 37, delete "oldie" and insert:
--of the--

Signed and Sealed this
Twenty-fifth Day of September, 2012

David J. Kappos

David J. Kappos
*Director of the United States Patent and Trademark Office*